US006897821B2

(12) United States Patent
Wong et al.

(10) Patent No.: US 6,897,821 B2
(45) Date of Patent: May 24, 2005

(54) SPACECRAFT OFF-GIMBAL IRU PRECISION PAYLOAD POINTING AND DISTURBANCE REJECTION SYSTEM

(75) Inventors: Robert L. Wong, South Pasadena, CA (US); Jason H. Q. Ly, Torrance, CA (US); Philip R. Dahl, Encino, CA (US); Arthur C. Or, Los Angeles, CA (US)

(73) Assignee: The Aerospace Corporation, El Segundo, CA (US)

( * ) Notice: Subject to any disclaimer, the term of this patent is extended or adjusted under 35 U.S.C. 154(b) by 115 days.

(21) Appl. No.: 10/634,022

(22) Filed: Aug. 4, 2003

(65) Prior Publication Data

US 2005/0030237 A1 Feb. 10, 2005

(51) Int. Cl.[7] ..... H01Q 3/00

(52) U.S. Cl. ..... 343/757; 343/754; 343/758; 343/760; 342/359; 342/358; 342/75; 342/77; 342/420

(58) Field of Search ..... 343/757, 754, 343/758, 760; 342/359, 358, 75, 77, 420, 76

(56) References Cited

U.S. PATENT DOCUMENTS

| | | | | | |
|---|---|---|---|---|---|
| 4,375,878 | A | * | 3/1983 | Harvey et al. | 244/158 R |
| 5,368,271 | A | * | 11/1994 | Kiunke et al. | 248/638 |
| 5,396,815 | A | * | 3/1995 | Polites et al. | 74/61 |
| 5,463,402 | A | * | 10/1995 | Walrath et al. | 342/359 |
| 5,557,285 | A | * | 9/1996 | Bender et al. | 342/359 |
| 6,433,736 | B1 | * | 8/2002 | Timothy et al. | 342/359 |

* cited by examiner

*Primary Examiner*—Don Wong
*Assistant Examiner*—Chuc Tran
(74) *Attorney, Agent, or Firm*—Derrick Michael Reid

(57) ABSTRACT

An off-gimbal pointing system is improved using filtering of resolver and gyro responses respectively applied at the output of the resolvers and gyros for attenuating high frequencies resolver responses and gyro responses that effectively degrades the high frequency responses that are matched and above the control system bandwidth for improving the overall dynamic control of the off-gimbal pointing system for rejecting the affects of base motion disturbances and vibrations.

13 Claims, 2 Drawing Sheets

OFF-GIMBAL CONTROL SYSTEM (NEW)

OFF-GIMBAL CONFIGURATION

OFF-GIMBAL CONTROL SYSTEM (PRIOR ART)

OFF-GIMBAL CONTROL SYSTEM (NEW)

SPACECRAFT OFF-GIMBAL IRU PRECISION PAYLOAD POINTING AND DISTURBANCE REJECTION SYSTEM

STATEMENT OF GOVERNMENT INTEREST

The invention was made with Government support under contract No. F04701-00-C-0009 by the Department of the Air Force. The Government has certain rights in the invention.

FIELD OF THE INVENTION

The invention relates to the field of payload pointing systems and inertially stabilized spaceborne gimbaled pointing and tracking systems. More particularly, the present invention relates to off-gimbal pointing system with base motion disturbance rejection for precise pointing of a payload pointing system.

BACKGROUND OF THE INVENTION

Inertially stabilized spaceborne off-gimbal pointing IRU and tracking systems have had a common system architecture. Referring to FIG. 1, the off-gimbal IRU pointing system utilizes relative angle sensors, such as inductosyns, encoders, resolvers as feedback control sensors collectively simply referred to herein as resolvers, utilizes gimbals for pointing an optical boresight along a desired line-of-sight LOS, and utilizes an inertial reference unit IRU typically having integrated X, Y, and Z gyroscopes integrated as a base motion sensor referred to simply as the gyro. The IRU is coupled to a controller while the gimbals are coupled to gimbals motors controlled by the controller. Specifically, the off-gimbal IRU pointing system includes two single-degree-of-freedom gimbals stacked in an orthogonal orientation and mounted on a base that serves as a platform. The gimbals have respective gimbal motors for driving the gimbals to desired positions as sensed by the resolvers relative to a base. There is an elevation gimbal and motor and an azimuth gimbal and motor. The pointing direction of the off-gimbal pointing system is represented by a telescopic boresight axis Xp. The boresight axis and the line-of-sight LOS are colinear. The resolvers measure angular rotations of the gimbal positions relative to the mounting base. As such, there is an azimuth resolver for measuring a relative azimuth angle $\phi$ of the azimuth gimbal and there is an elevation resolver for measuring a relative elevation angle $\theta$ of the elevation gimbal, as the gyro measures inertial angular rate motion.

The base is a platform to which is coupled the gimbaled mechanisms, including the gimbals, optics defining the boresight, the resolvers, and the gyro. The boresight is maintained along a line-of-sight to a target. The base coordinate frame is defined by the mounting orientation of the IRU. That is, the base and IRU coordinate axes are coincident and designated as Xb, Yb, and Zb. The azimuth gimbal is defined to be mounted directly to the base. The gimbal azimuth axis Zg is nominally aligned with the vertical base axis Zb of the IRU. Angular orientation about Zb is designated as azimuth angle $\phi$ and is measured by the azimuth resolver mounted between the base and the azimuth gimbal. The elevation gimbal is mounted on top of the azimuth gimbal. The gimbal elevation axis Yg is nominally oriented orthogonal to the azimuth gimbal. Angular rotations of the elevation angle $\theta$ about the gimbal elevation axis Yg is measured by the elevation resolver mounted between the azimuth gimbal and elevation gimbal. The boresight Xp for the pointing system is defined to be statically fixed in the elevation gimbal coordinate frame and orthogonal to the elevation gimbal axis Yg. There is a coordinate frame associated with the azimuth gimbal (Xa, Ya, Za) and a coordinate frame associated with the elevation gimbal (Xe, Ye, Ze). Hence, there are three coordinate frames, the base frame (Xb, Yb, Zb), the azimuth frame (Xa, Ya, Za), and the elevation frame (Xe, Ye, Z ). A fourth reference frame is the boresight pointing frame (Xp, Yp, Zp). Because each of the gimbals only has a single degree of freedom, only rotational coordinate axes are us d. The azimuth and el vation coordinate frames are Za=Zb, Ye=Ya=Yg, Xp=Zp, Yp=Ye=Ya=Yg, and Zp=Ze. This leads to a transformation from base frame (Xb, Yb, Zb) to the pointing frame (Xp, Yp, Zp) by two Euler angle rotations $\phi$ and $\theta$ that are measured on the Zg=Za=Zb axis and the Yg=Ya axis. These two axis Zg=Za=Zb axis and the Yg=Ya axis are orthogonal.

A zero readout position of the elevation resolver orients the boresight Xp to be orthogonal to the gimbal azimuth axis Yg. The zero readout position of the azimuth resolver orients the gimbal elevation axis Yg to be coplanar with the base axis Yb. Because the gimbals only have a single degree-of-freedom rotational capability, the gimbal azimuth axis Zg will be aligned with the base Zb axis while the gimbal elevation axis Yg will always be parallel to the base plane defined by a horizontal base axis Xb and a vertical base axis Yb. The base axis Xp has an angular rate $\omega$Xb indicating spatial rotation of the base. The boresight direction Xp can then be computed with respect to the base as a set of Euler angle rotations given by the resolver readouts. Because the IRU gyros measure the orientation of the base with respect to inertial space, the boresight can be transformed into an inertial coordinate frame.

Referring to FIGS. 1 and 2, and more particularly to FIG. 2, an off-gimbal IRU control system controls the physical operation of the off-gimbal pointing system. The controller C is a system controller for maintaining the bor sight as a desired line-of-sight LOS. The control system is a dynamic system for maintaining a desired line of sight under closed-loop control. The controller provides direction signals to the gimbal motors that in turn provide torque to control the movement of the gimbals. The plant P represents a model of the inertia of the gimbals and provides a pointing angle for maintaining the boresight line of sight. The output of the plant P is the mechanical angular movement of the telescopic boresight about the Yg and Zg axes. External vibration and disturbances are effectively mechanically summed by the coupling of gimbals and telescope to the base through the compliance K that models a gimbal suspension system of the azimuth and elevation gimbals. The base motion M is received by the control system. The base motion M is sensed by the gyro, as the base motion M excites the modeled spring suspension defined by compliance K that is summed as a torque with to the gimbal drive torque. The resolver R provides the relative sensor feedback of the measured boresight angle relative to the base. The feedback for both resolvers is coupled to the controller. The gyro G is a feed forward inertial gyro sensor that provides the measured angular rates $\omega$Xb, $\omega$Yb, and $\omega$Zb of the base. The measured angular motion of the base motion M is coupled to the controller. An input command CMD is received by the controller and the controller provides the gimbal drive signals to torque the telescopic boresight to the commanded desired line-of-sight LOS. The purpose of the off-gimbal IRU pointing system is to control the telescopic boresight to be driven to and maintained at the desired line-of-sight LOS in the pr sence of mechanical base motion and disturbances M. The gimbals, as modeled by the plant P, are inertially commanded to an orientation specified by the command CMD so as to point the boresight along the desired line-of-sight while attenuating the effects of mechanical disturbances of the base motion M.

The off-gimbal IRU control system provides an analytic coupling of the base motion M with the gyro G and resolver R sensor measurements for dynamic closed-loop control of the telescopic boresight. The base motion M excites the gimbals as modeled by the plant dynamics P and through the gimbal compliance K. The suspension compliance K and resolver R both are affected by a sum of the line-of-sight movement and the base motion M. Essentially, the gimbal compliance K acts as a passive isolator in coupling base motion M to the inertia of the gimbals modeled by the plant P. The more compliant compliance K is, the more high frequency motion from the base is rejected. The deficient suppression of low frequency components of the base motion disturbance pass through the compliance K unattenuated for following the command CMD. The gyros G are used in a feed forward loop and resolvers R are sensors used in the closed-loop to drive the boresight to the desired line-of-sight LOS, but mechanical disturbances can produce unwanted motion of the gimbals as sensed by the resolvers. The gyro G and resolver R measurements to the controller C in the feedback control system of FIG. 2, have frequency response components from the excitation of base motion disturbance M that could be rejected. The system is designed to have a fast response time to maintain the boresight on the desired line-on-sight. The control system perfectly follows low frequency components of the base motion M to maintain the boresight on the desired line-on-sight.

Ideal resolvers R measure the relative angle between the base and the gimbal orientation to infinite bandwidth. Ideal gyros G measure the inertial angle of the base with infinite bandwidth. Together, these two sensors measure the total motion of the boresight. By differencing or summing the resolver R measurements with the gyro G measurements, the direction of the line-of-sight LOS with respect to the input Command CMD is computed perfectly. The problem with this computation is that ideal resolvers and ideal gyros do not exist, but rather have a band-limited responses. As a consequence, there will be a residual error, which is a function of bandwidth when these two sensors are summed or differenced. When the bandwidth of the resolvers and gyros are well above the bandwidth of the control loop, for example by a factor of ten, then the bandwidth difference between the gyros and resolvers are negligible. The feedback control system will attenuate the effects of the sensor bandwidth mismatch whenever the mismatch occurs outside of the control loop bandwidth. If additional base motion rejection performance is desired, the design practice has been to increase loop bandwidth with the result that sensor bandwidths had to also increase. Increasing gyro bandwidths can be a costly. Typical bandwidths for resolvers are about 1.0 kHz, while that of gyros for spaceborne applications ar less than 50 Hz. Further, it is design practice to increase the bandwidth of gyros alone to achieve additional performance out of a control system. Conventional practices dictate that improving sensor response can only result in improved system response. This leads to efforts to increase the performance bandwidth of the lowest bandwidth sensor that is usually the gyros. To achieve this improved bandwidth response, there is are significant cost increases of the gyro manufacturers. This is a disadvantageous limitation of the off-gimbal IRU design approach to base motion rejection. These and other disadvantages are solved or reduced using the invention.

SUMMARY OF THE INVENTION

An object of th invention is to provide an off-gimbal pointing system with improved dynamic closed-loop control.

Another object of the invention is to provide an off-gimbal pointing system with improved dynamic closed-loop control by providing filtered measurement responses.

Yet another object of the invention is to provide an off-gimbal pointing system with improved dynamic closed-loop control by providing filtered resolver and gyro measurement responses.

Still another object of the invention is to provide an off-gimbal pointing system with improved dynamic closed-loop control by providing filtered resolver and gyro measurement responses using filtering.

A further object of the invention is to provide an off-gimbal pointing system with improved dynamic closed-loop control by providing filtering resolver measurement responses and filtering gyro measurement responses.

A conventional off-gimbal pointing system is improved with the addition of filtering of resolver and gyro measurement responses. Resolver filtering is applied at the output of the resolvers for attenuating at least high frequencies components of resolver responses. Gyro filtering is applied at the output of the gyros for attenuating at least high fr quency gyro responses. In the pref rred form, the resolver filtering and gyro filtering shape the respective resolver and gyro responses to be matching in bandwidth that is greater the closed-loop system bandwidth. By effectively degrading the high frequency measurement responses of the gyros and resolvers, the dynamic control of the off-gimbal pointing system is improved and suitable for reducing the effects of base motion disturbances. These and other advantages will become more apparent from the following detailed description of the preferred embodiment.

DETAILED DESCRIPTION OF THE PREFERRED EMBODIMENT

Figure 1:
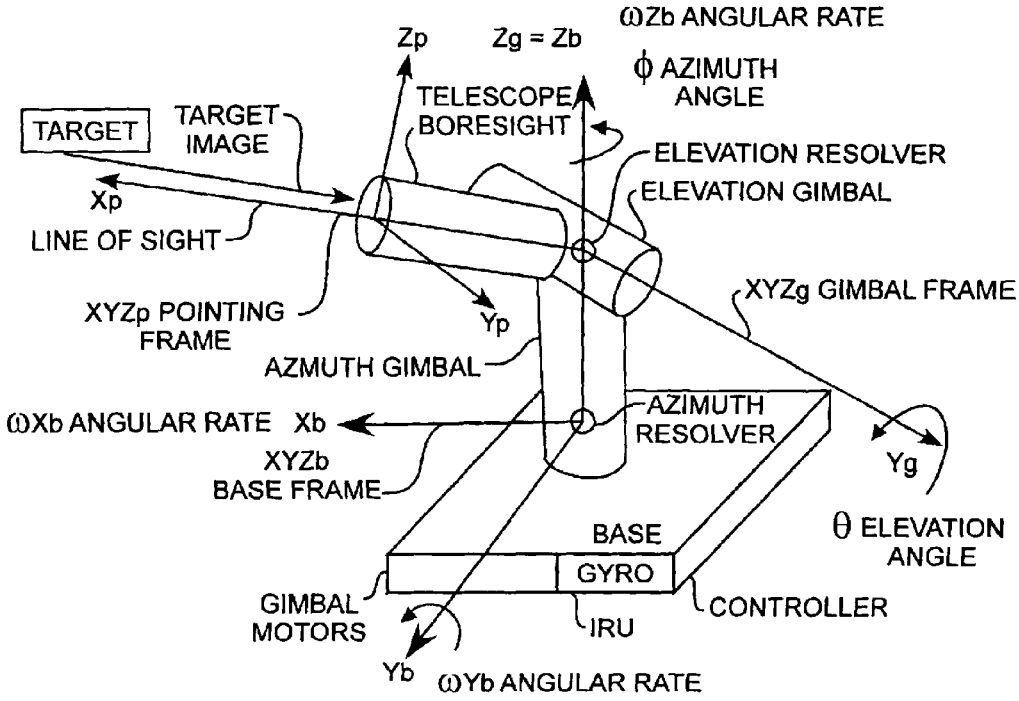
FIG. 1 depicts a conventional off-gimbal pointing system.
Figure 2:
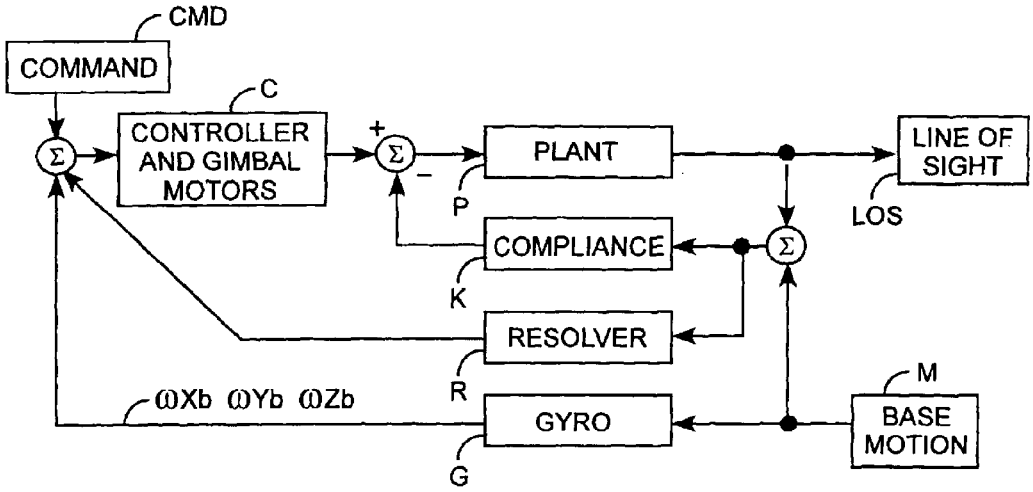
FIG. 2 is block diagram of a conventional off-gimbal control system.
Figure 3:
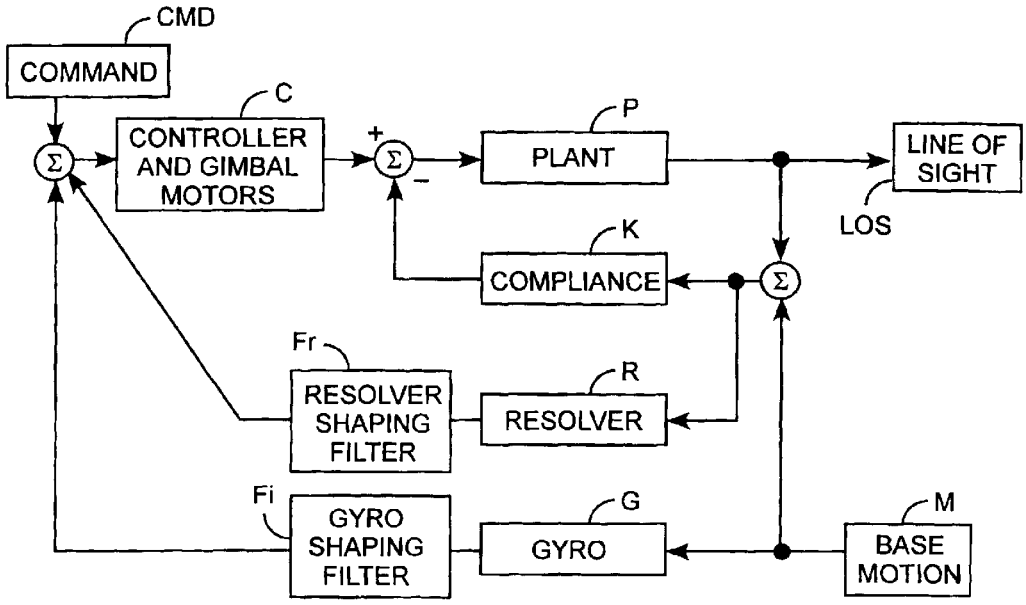
FIG. 3 is block diagram of an improved off-gimbal control system.

An embodiment of the invention is described with reference to the figures using reference designations as shown in the figures. Referring to all of the Figures, and more particularly to FIG. 3, the improved off-gimbal control system includes the addition of a resolver shaping filter Fr and a gyro shaping filter Fi. The control system utilizes resolvers as feedback control sensors, utilizes gimbals for pointing an optical boresight along a desired line-of-sight LOS, and preferably utilizes an inertial reference unit IRU typically having integrated X, Y, and Z gyroscopes as base motion sensors. The IRU is coupled to a controller. The gimbals are coupled to gimbals motors controlled by the controller. The motors drive the gimbals to a desired position as sensed by the resolvers relative to the base. An elevation gimbal and motor and an azimuth gimbal and motor are used to position the telescopic boresight axis Xp, that is, the line-of-sight LOS. The azimuth resolver measures the relative angle of the azimuth gimbal. The elevation resolver measures a relative elevation angle θ of the elevation gimbal. The resolvers measure angular rotations of the gimbal positions relative to the mounting base. The gyro measures inertial angular motion of the base.

The off-gimbal control system controls the physical operation of the off-gimbal pointing system. The controller C is a system controller for maintaining the bor sight as a desired line-of-sight LOS. The control system is a dynamic closed-loop system for maintaining the boresight at a desired line-of-sight. The controller C provides direction signals to the gimbal motors that controls the movement of the gimbals. The plant P is a model of the inertia of the gimbals and provides a pointing angle for maintaining the boresight line-of-sight LOS. The output of the plant is the mechanical movement of the telescopic boresight along the line-of-sight LOS. External vibrations and disturbances are effectively mechanically summed as a mechanical excitation coupled through gimbals and telescope to the base. The compliance K models the gimbal suspension system of the azimuth and elevation gimbals. The azimuth and elevation gimbals are a part of a gimbal system. The base motion M includes relative base motion such as the trajectory of a supporting spacecraft and vibration disturbances that are received by the base as angular rates of ωXb, ωYb, and ωZb from the gyros. That is, the base motion is sensed by the gyros. The mechanical movements M and disturbances excite the modeled spring suspension. The compliance K is summed as a torque signal to the gimbal drive signals from the controller for maintaining the boresight along the desired line-of-sight LOS. The resolver R is a resolver system that provides the relative sensor feedback of the measured resolver angle for both the elevation and azimuth resolvers to the controller C. The gyro G is a gyro system that provides angular rates ωXb, ωYb, and ωZb to the gyro filter Fi. An input command CMD is received and is summed with filtered resolver responses from the resolv r filter Fr and is summed with the filtered gyro responses from the gyro filter Fi by the off-gimbaled controller as the controller provides the gimbal drive signals to drive the telescopic boresight to the commanded desired line-of-sight LOS during a closed-loop operation. The purpose of the off-gimbaled pointing system is to control the telescopic boresight to be driven to and maintained at the desired line-of-sight LOS in the presence of mechanical motion and disturbances M. The gimbals, as modeled by the plant P, are inertially commanded to an orientation by the specified command CMD so as to point the boresight along the desired line-of-sight while attenuating the effects of mechanical disturbances of the base motion M.

The off-gimbal control system provides an analytic coupling of the base motion M with the gyro G and resolver R sensor measurements for dynamic closed-loop control of the telescopic boresight. The base motion excites the gimbals, modeled by the plant dynamics P through the gimbal compliance K. The suspension compliance K and resolver R are affected by a sum of the line of sight movement as provided by the plant P modeling of the gyros and the base motion M. Essentially, the gimbal compliance K acts as a passive isolator in coupling base motion M to the inertia of the gimbals modeled by the plant P. The more compliant compliance K is, the more high frequency motion from the base is rejected. The deficient suppression of low frequency components of base motion disturbance pass through the compliance K unattenuated causing accurate pointing of the pointing system. The gyros G and resolvers R are sensors used during the clos d-loop control to drive the boresight to the desir d line-of-sight LOS, but m chanical disturbances can produce unwant d motion of the gimbals and the base as respectively sensed by the resolvers and gyros. The filtered gyro and resolver responses are summed with the input command as a control input to the controller C as part of a feedback closed-loop control system having frequency response components from the excitation base motion disturbance M. The resolvers are in the closed-loop while the gyros are in a feed forward loop. The system is designed to have a fast response time using high frequency response gyros and resolvers to maintain high frequency performance with respect to maintaining the boresight along the desired line-of-sight commanded but with filtering of the gyro and resolver responses. By degrading high frequency components, and preferably matching the resolver and gyro effective filtered responses using the filters Fr and Fi, the control system maintains the telescopic boresight to be on the desired line-of-sight in the presence of base motion as well as motion of the telescopic boresight.

The resolver R measures the relative angle between the base and the gimbal orientation. The gyro G measures the inertial angle of the base. Together, the resolver and gyro sensors measure the total motion of the boresight. By differencing or summing the resolver R measurements with the gyro G measurements, the direction of the line-of-sight LOS with respect to the input command CMD is computed. The resolvers and gyros have a high frequency band limited response. As a consequence, there will be a residual error, which is a function of bandwidth, when these two sensors are summed or differenced. The bandwidth of the resolvers and gyros are well above the bandwidth of the control loop, for example by a factor of ten. The gyro and resolver need only a bandwidth equal to or greater than the system bandwidth of the control closed-loop. The resolver and gyro filtering effectively lower the operational bandwidth of the gyros and resolvers. As such, high frequency response component of the gyro and resolvers are attenuated so that residual errors in the high frequency domain from the gyro and resolver are reduced. Hence, the feedback control system will attenuate the resolver and gyro responses in the high frequency domain, for improved performance. As such, lower frequency and consequently less costly resolvers and gyros may be used. The bandwidths for resolvers are about 1.0 kHz, while the bandwidth of the gyros for spaceborne applications are about 60 Hz, and while the responses of the closed-loop system is about 10 Hz. The filtering may have a 0.2 kHz pole for reducing high frequency components above 0.2 kHz. Preferably, the filtered frequency responses of the resolvers and gyros are match and have an upper pole at 50 Hz, such that both filtered responses are degraded and matched but remain greater than the 10 Hz closed-loop control system bandwidth response. As such, the control closed-loop system is not excited at the input of the controller with unwanted high frequency signals outside the frequency response of the control system. Those skilled in the art can make enhancements, improvements, and modifications to the invention, and these enhancements, improvements, and modifications may nonetheless fall within the spirit and scope of the following claims.

What is claimed is:

1. A pointing system for pointing a boresight along a desired line-of-sight in response to a command to point the boresight along the desired line-of-sight, the system comprising, a base for providing a platform and for coupling base motion and line-of-sight motion of the boresight for providing a mechanical excitation, a gimbal system comprising an elevation gimbal and an azimuth gimbal for positioning a boresight along the desired line-of-sight relative to the base, the elevation gimbal and the azimuth gimbal are modeled by a plant, the elevation gimbal and the azimuth gimbal comprise a suspension modeled by a compliance receiving the mechanical excitation and providing a compliance signal, the elevation gimbal and the azimuth gimbal are controlled by a torque signal being a sum of a compliance signal and a drive signal, a resolver system comprising an elevation resolver and an azimuth resolver for respectively measuring as resolver responses a relative elevation angle and a relative azimuth angle of the boresight relative to the base, a resolver filter system for resolver filtering of the resolver responses for providing a filtered resolver response, the mechanical excitation being applied to the resolver system for providing the resolver responses, a gyro system comprising X and Y and Z gyros for measuring as gyro responses X and Y and Z angular rates of the base motion, a gyro filter for gyro filtering of the gyro responses for providing filtered gyro respons s, and a controller comprising gimbal motors for receiving a control input and providing motion control to the elevation gimbal and the azimuth gimbal, the control input signal being a sum of the command and the filtered resolver responses and the filtered gyro responses.

2. The system of claim 1 wherein, the gyro system has high frequency responses effectively attenuated by the gyro filter.

3. The system of claim 1 wherein, the resolver system has a high frequency response effectively attenuated by the resolver filter.

4. The system of claim 1 wherein, the gyro system is an inertial reference unit.

5. The system of claim 1 wherein, the base motion comprises vibrations.

6. The system of claim 1 wherein, the base motion comprise trajectory motions of a moving spacecraft coupled to the base.

7. The system of claim 1 wherein, the controller and plant and compliance and resolver system are part of a closed-loop system having a system bandwidth, the resolver system has a resolver frequency response greater than the system bandwidth, and the resolver filter serves to shape the resolver response to reduce high frequency components of the resolver responses.

8. The system of claim 1 wherein, the controller and plant and compliance and resolver system are a part of a closed-loop system having a system bandwidth, the gyro system has a gyro frequency response greater than the system bandwidth, and the gyro filter serves to shape the gyro response to reduce high frequency components.

9. The system of claim 1 wherein, the controller and plant and compliance and resolver system and resolver system are part of a closed-loop system having a system bandwidth, the resolver system has a resolver frequency response greater than the system bandwidth, and the gyro system has a gyro frequency response greater than the system bandwidth, the resolver frequency response is greater than the gyro frequency response, the resolver filter and gyro filter serves to match the resolver frequency response to the gyro frequency response.

10. The system of claim 1 wherein, the controller and plant and compliance and resolver system and resolver system are part of a closed-loop system having a system bandwidth, the resolver system has a resolver frequency response greater than the system bandwidth, and the gyro system has a gyro frequency response greater than the system bandwidth, the resolver frequency response is greater than the gyro frequency response, the resolver filter and gyro filter serves to match the resolver frequency response to the gyro frequency response above the system bandwidth.

11. The system of claim 1 wherein, the controller and plant and compliance and resolver system are part of a closed-loop system have a system bandwidth, and the gyro system is part of a feed forward loop.

12. A pointing system for pointing a boresight along a desired line-of-sight in response to a command to point the boresight along the desired line-of-sight, the system comprising, a base for providing a platform and for coupling base motion and line-of-sight motion of the boresight for providing a mechanical excitation, a gimbal system comprising an elevation gimbal and an azimuth gimbal for positing a boresight along the desired line-of-sight relative to the base, the elevation gimbal and the azimuth gimbal are modeled by a plant, the elevation gimbal and the azimuth gimbal comprise a suspension modeled by a compliance receiving the mechanical excitation, the elevation gimbal and the azimuth gimbal are controlled by a torque signal being a sum of a compliance signal from the modeled compliance and a drive signal, a gyro system comprising X and Y and Z gyros for measuring as gyro responses the X and Y and Z angular rates of the base having the base motion, a gyro filter for gyro filtering of the gyro responses for providing filtered gyro responses, a controller comprising gimbal motors for receiving a control input and providing motion control to the elevation gimbal and the azimuth gimbal, the control input signal being a sum of the command and the filtered gyro responses.

13. A pointing system for pointing a boresight along a desired line-of-sight in response to a command to point the boresight along the desired line-of-sight, the system comprising, a base for providing a platform and for coupling base disturbances to the line-of-sight of the boresight for providing a mechanical excitation, a gimbal system comprising an elevation gimbal and an azimuth gimbal for positing a boresight along the desired line-of-sight relative to the base, the elevation gimbal and the azimuth gimbal are modeled by a plant, the elevation gimbal and the azimuth gimbal comprise a suspension modeled by a compliance receiving the mechanical excitation, the elevation gimbal and the azimuth gimbal are controlled by a torque signal being a sum of a compliance signal from the modeled compliance and a drive signal, a resolver system comprising an elevation resolver and an azimuth resolver for respectively measuring a relative elevation angle and a relative azimuth angle of the boresight relative to the base as resolver responses, a resolver filter system for resolver filtering of the resolver responses for providing a filtered resolver response, the mechanical excitation being applied to the resolver system for providing the resolver responses, a controller comprising gimbal motors for receiving a control input and providing motion control to the elevation gimbal and the azimuth gimbal, the control input signal being a sum of the command and the filtered resolver responses.

* * * * *